US007438373B2

(12) United States Patent
Yamanobe

(10) Patent No.: US 7,438,373 B2
(45) Date of Patent: Oct. 21, 2008

(54) LIQUID DROPLET EJECTION APPARATUS

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 208 days.

(21) Appl. No.: 11/386,837

(22) Filed: Mar. 23, 2006

(65) Prior Publication Data

US 2006/0214959 A1 Sep. 28, 2006

(30) Foreign Application Priority Data

Mar. 24, 2005 (JP) ..... 2005-086949

(51) Int. Cl.
*B41J 29/38* (2006.01)

(52) U.S. Cl. ..... 347/12; 347/9

(58) Field of Classification Search ..... 347/12, 347/9

See application file for complete search history.

(56) References Cited

U.S. PATENT DOCUMENTS 6,010,205 A * 1/2000 Billet ..... 347/40
6,089,693 A * 7/2000 Drake et al. ..... 347/19
6,565,174 B2 5/2003 Kamoshida et al.

FOREIGN PATENT DOCUMENTS

JP 2002-240257 A 8/2002

* cited by examiner

*Primary Examiner*—Matthew Luu
*Assistant Examiner*—Brian J Goldberg
(74) *Attorney, Agent, or Firm*—Birch, Stewart, Kolasch & Birch, LLP

(57) ABSTRACT

The liquid droplet ejection apparatus comprises: a plurality of ejection ports which eject droplets to form dots on a recording medium to form an image on the recording medium; and a droplet ejection control device which, if a time interval during which one of the ejection ports does not eject any droplet exceeds a prescribed time period, and if an effect on the image, when a dot that is to be formed by a droplet ejected from the one of the ejection ports after the prescribed time period has elapsed is a defective dot, exceeds a tolerance limit, then causes the one of the ejection ports to perform an additional ejection of a droplet to form a corrected dot, in such a manner that the droplet is correctly ejected to form the dot of which the effect on the image would exceed the tolerance limit.

6 Claims, 13 Drawing Sheets

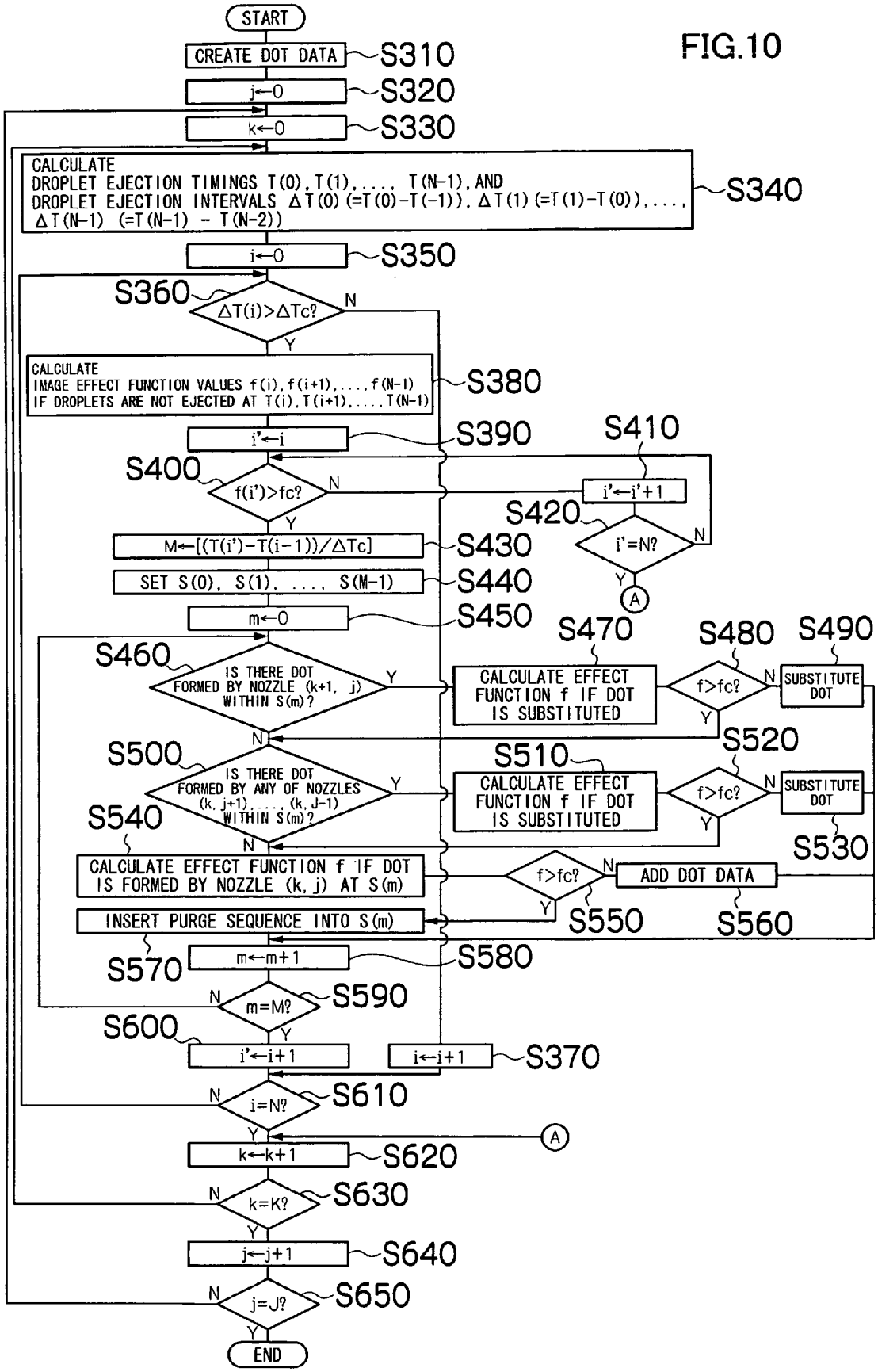
FIG.10
START
CREATE DOT DATA
S310
j←0
S320
k←0
S330
CALCULATE DROPLET EJECTION TIMINGS T(0), T(1), ..., T(N-1), AND DROPLET EJECTION INTERVALS ΔT(0) (=T(0)-T(-1)), ΔT(1) (=T(1)-T(0)), ..., ΔT(N-1) (=T(N-1) - T(N-2))
S340
i←0
S350
S360
ΔT(i)>ΔTc?
N
Y
CALCULATE IMAGE EFFECT FUNCTION VALUES f(i), f(i+1), ..., f(N-1) IF DROPLETS ARE NOT EJECTED AT T(i), T(i+1), ..., T(N-1)
S380
i'←i
S390
S410
S400
f(i')>fc?
i'←i'+1
S420
i'=N?
M←[(T(i')-T(i-1))/ΔTc]
S430
SET S(0), S(1), ..., S(M-1)
S440
A
m←0
S450
S470
S480
S490
S460
IS THERE DOT FORMED BY NOZZLE (k+1, j) WITHIN S(m)?
CALCULATE EFFECT FUNCTION f IF DOT IS SUBSTITUTED
f>fc?
SUBSTITUTE DOT
S500
S510
S520
IS THERE DOT FORMED BY ANY OF NOZZLES (k, j+1), ..., (k, J-1) WITHIN S(m)?
CALCULATE EFFECT FUNCTION f IF DOT IS SUBSTITUTED
f>fc?
SUBSTITUTE DOT
S540
S530
CALCULATE EFFECT FUNCTION f IF DOT IS FORMED BY NOZZLE (k, j) AT S(m)
f>fc?
ADD DOT DATA
S550
S560
INSERT PURGE SEQUENCE INTO S(m)
S570
m←m+1
S580
m=M?
S590
S600
i'←i+1
i←i+1
S370
i=N?
S610
A
k←k+1
S620
k=K?
S630
j←j+1
S640
j=J?
S650
END

LIQUID DROPLET EJECTION APPARATUS

BACKGROUND OF THE INVENTION

1. Field of the Invention

The present invention relates to a liquid droplet ejection apparatus, and more particularly, to a liquid droplet ejection apparatus in which droplets are ejected from a plurality of ejection ports to form dots on a recording medium.

2. Description of the Related Art

An inkjet type of image forming apparatus has a print head formed with a plurality of nozzles (ejection ports), and forms images on a recording medium by ejecting ink droplets from nozzles onto a recording medium, while conveying the print head and the recording medium relatively with respect to each other. The printing method in an image forming apparatus of this kind may be a shuttle method which performs recording by scanning the recording medium in the breadthways direction thereof with a short serial head, and a line method which uses a line head in which nozzles are arranged so as to correspond to the full width of the recording medium.

In an image forming apparatus of this kind, during printing, the nozzles are always filled with ink, in such a manner that printing is carried out immediately when a printing instruction is issued. Therefore, if nozzles remain in a state in which ink droplets are not ejected for a prescribed time period or longer, then the ink in the vicinity of the nozzles increases in viscosity, and even if a normal ink ejection signal is subsequently applied, there may be variation in the dot size or dot landing positions, or the nozzles may become blocked, in such a manner that it becomes impossible to eject ink droplets (hereinafter, these situations are referred to generally as "ejection defects"). Therefore, in a print head, maintenance operations are carried out at prescribed time intervals in order forcibly to eject or suction ink of increased viscosity which causes ejection defects. Maintenance operations of this kind reduce the printing speed and cause wasteful consumption of the ink.

In order to resolve problems of this kind, Japanese Patent Application Publication No. 2002-240257 discloses a droplet ejection control method which performs a print operation by detecting nozzles that have not been used for a prescribed period of time, and changes the scanning data (dot data) and paper conveyance amount in such a manner that these nozzles are used. The droplet ejection control method according to Japanese Patent Application Publication No. 2002-240257 is described with reference to an example shown in FIG. 14. In FIG. 14, a print operation is performed by moving a print head 150 in a scanning direction perpendicular to the paper conveyance direction, while conveying a recording medium in the paper conveyance direction. Each of the dots on the recording medium indicates scan data which has been converted from print data (image data). The print head 150 has five nozzles N1, N2, N3, N4 and N5, and is able to print five lines by means of a single printing operation. When the printing of one scan has completed, the recording medium is conveyed in the paper conveyance direction through a distance corresponding to five lines. By repeating the scanning movement of the print head 150 and the conveyance of the recording medium in this fashion, a normal printing operation is carried out. Here, it is supposed that, at the end of the printing onto region A in the initial scanning, nozzle N3 is determined to be an unused nozzle that has not been used once during a certain prescribed time period. Normally, in the next scan, the nozzle to print line B1 would be nozzle N1, and the nozzle to print line B2 would be nozzle N2, but according to this droplet ejection control method, the next scanning data is rewritten in such a manner that lines B1 to B4 are printed respectively by nozzles N2 to N5 so that the nozzle N3 is used. Here, the recording medium is conveyed through a distance of four lines, which is reduced by one line from the normal paper conveyance amount (five lines).

However, in the droplet ejection control method disclosed in Japanese Patent Application Publication No. 2002-240257, if an unused nozzle which has not been used for a prescribed period of time is detected, then the scanning data and the paper conveyance amount are changed in such a manner that the unused nozzle is used, regardless of the effects on the image that might occur if the unused nozzle is suffering an ejection defect and droplets cannot be ejected correctly from the unused nozzle in order to form the dots that are supposed to be formed.

For example, in the example shown in FIG. 14, there is no scan data in the lines A3, B3 and C3, which are originally to have been printed by the nozzle N3 that has been determined to be the unused nozzle, and therefore, even if the nozzle N3 is suffering an ejection defect, this has absolutely no effect on the image. However, in the droplet ejection control method in the related art, the scan data is changed in order to use the nozzle N3 and the paper conveyance amount is reduced accordingly, thereby leading to a decline in the printing speed.

SUMMARY OF THE INVENTION

The present invention has been contrived in view of the aforementioned circumstances, an object thereof being to provide a liquid droplet ejection apparatus which prevents image deterioration caused by ejection defects in nozzles, without leading to a decline in the printing speed.

In order to attain the aforementioned object, the present invention is directed to a liquid droplet ejection apparatus, comprising: a plurality of ejection ports which eject droplets to form dots on a recording medium to form an image on the recording medium; and a droplet ejection control device which, if a time interval during which one of the ejection ports does not eject any droplet exceeds a prescribed time period, and if an effect on the image, when a dot that is to be formed by a droplet ejected from the one of the ejection ports after the prescribed time period has elapsed is a defective dot, exceeds a tolerance limit, then causes the one of the ejection ports to perform an additional ejection of a droplet to form a corrected dot, in such a manner that the droplet is correctly ejected to form the dot of which the effect on the image would exceed the tolerance limit.

According to the present invention, a droplet is ejected from one of the ejection ports to form a corrected dot, in such a manner that a droplet to form a dot that would affect the image if the correction were not performed is correctly ejected from the one of the ejection ports. In other words, the droplet ejection correction is not implemented in cases where the image is not affected by the defective dot. Hence, it is possible to prevent image deterioration due to ejection defects, without leading to a decline in the printing speed.

The time interval during which the one of the ejection ports does not eject any droplet also includes the time interval from the starting timing of the print operation until the timing at which a droplet is to be ejected to form a first dot.

Preferably, the corrected dot is substituted for a dot to be formed by a droplet ejected by another of the ejection ports, or the corrected dot is a new additional dot to be formed by the droplet ejected from the one of the ejection ports.

Preferably, the droplet ejection control device does not cause the one of the ejection ports to perform the additional ejection in a case where the corrected dot has the effect on the image exceeding the tolerance limit.

According to this aspect of the present invention, it is possible to prevent image deterioration in a case where the one of the ejection ports ejects the droplet to form the corrected dot.

Preferably, the time interval during which the one of the ejection ports does not eject any droplet is made to be shorter than the prescribed time period, due to the additional ejection.

According to this aspect of the present invention, it is possible to prevent ejection defects in the ejection ports, in advance.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 10 is a flowchart showing a droplet ejection control method according to a first embodiment of the present invention;

DETAILED DESCRIPTION OF THE PREFERRED EMBODIMENTS

General Composition of Inkjet Recording Apparatus

Figure 1:
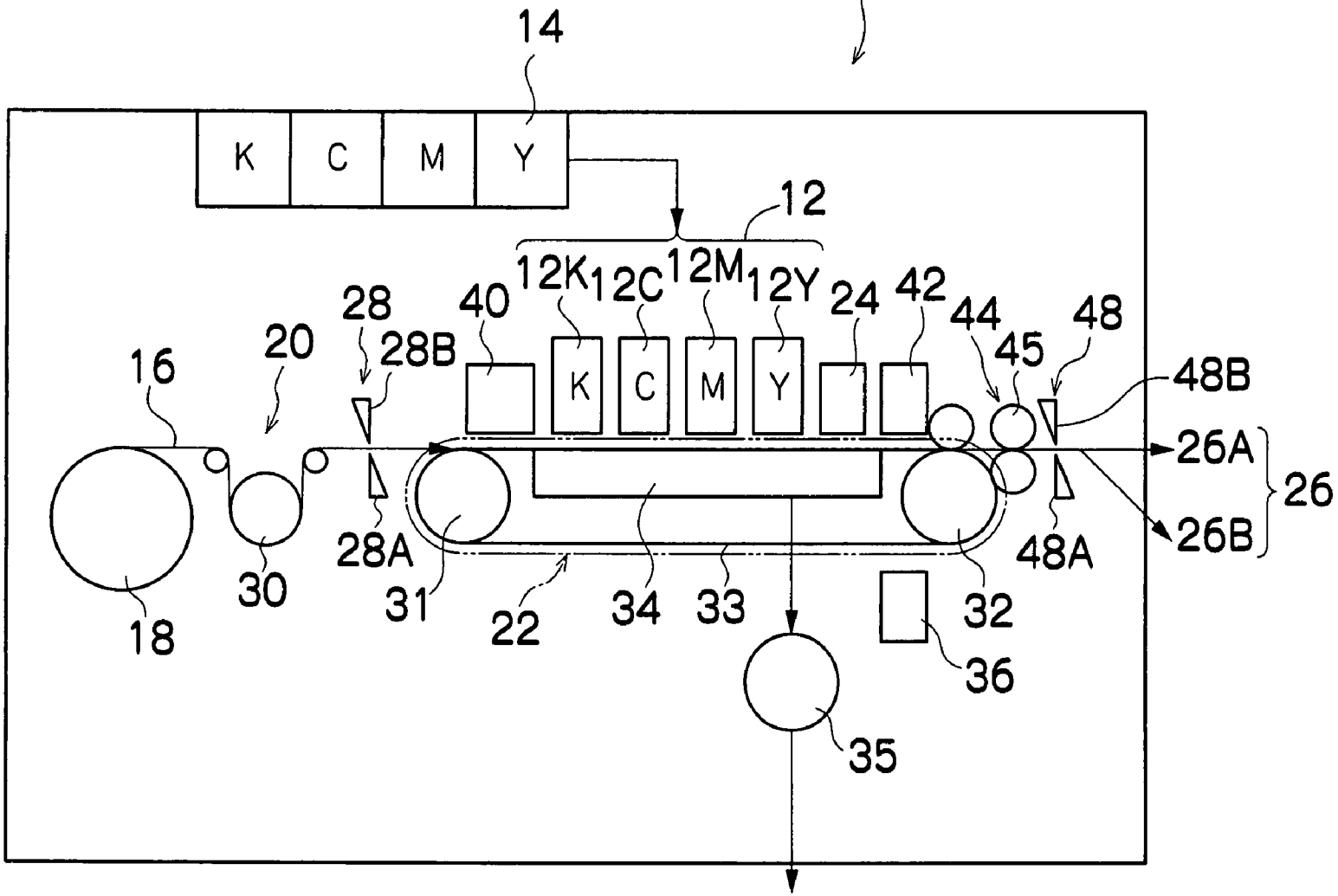
FIG. 1 is a general schematic drawing of an inkjet recording apparatus.

FIG. 1 is a general schematic drawing of an inkjet recording apparatus forming one embodiment of an image forming apparatus to which the present invention is applied. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 is a so-called "full line head" in which a line head having a length corresponding to the maximum paper width is arranged in a direction (main scanning direction) that is perpendicular to the paper conveyance direction (sub-scanning direction).

More specifically, the print heads 12K, 12C, 12M and 12Y forming the printing unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (left side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) which is perpendicular to the paper conveyance direction.

Although a configuration with the KCMY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter)

48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Structure of Print Head

Next, the structure of a print head is described. The print heads 12K, 12C, 12M and 12Y of the respective ink colors have the same structure, and a reference numeral 50 is hereinafter designated to any of the print heads.

Figure 2A:
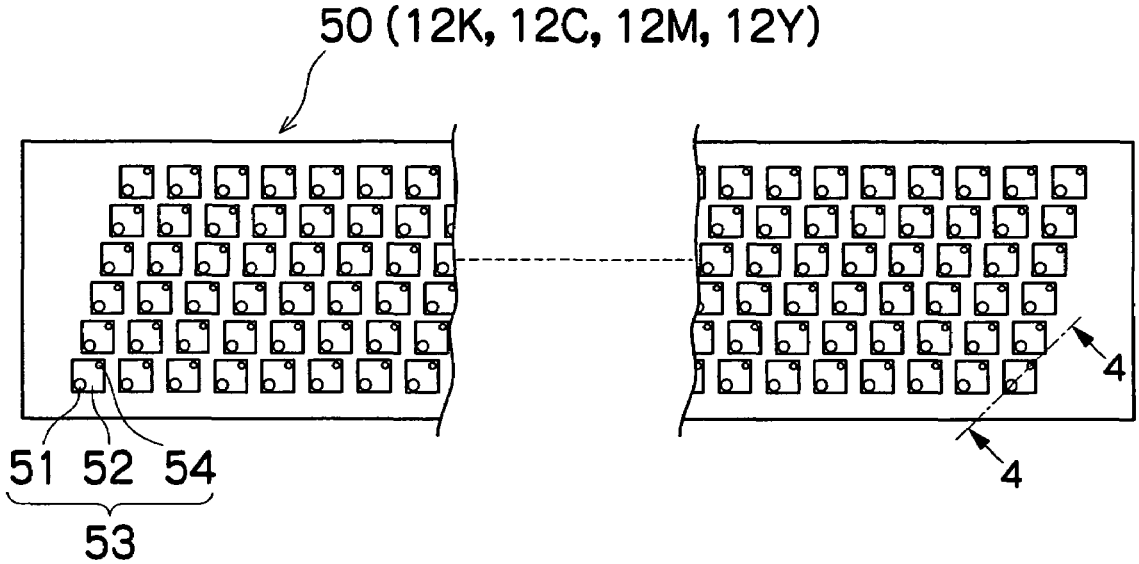
FIGS. 2A and 2B are plan perspective diagrams showing an embodiment of the structure of a print head.
Figure 2B:
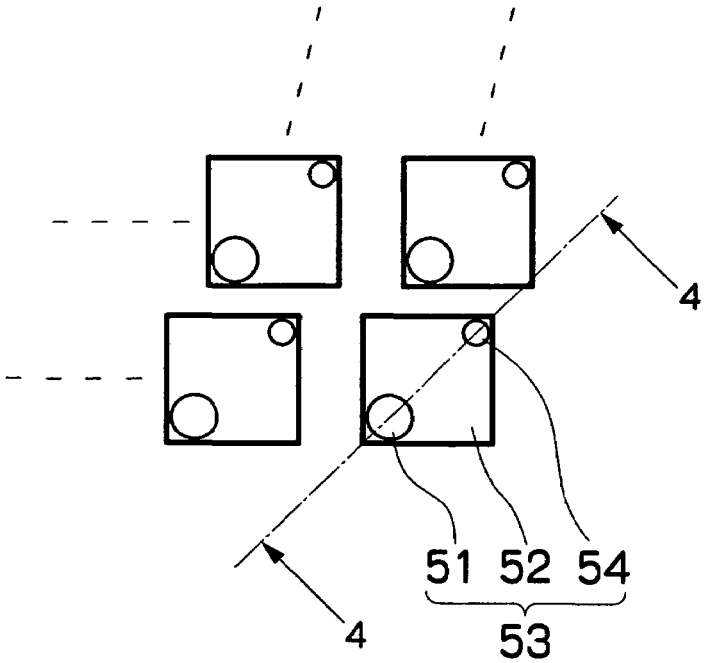

FIG. 2A is a plan view perspective diagram showing an embodiment of the composition of a print head 50, and FIG. 2B is an enlarged diagram of a portion of same. The nozzle pitch in the head 50 should be minimized in order to maximize the resolution of the dots printed on the surface of the recording paper 16. As shown in FIGS. 2A and 2B, the print head 50 according to the present embodiment has a structure in which a plurality of ink chamber units 53, each having a nozzle 51 which is an ink droplet ejection port, a pressure chamber 52 corresponding to the nozzle 51, and the like, are disposed (two-dimensionally) in the form of a staggered matrix, and hence the effective nozzle interval (the projected nozzle pitch) as projected in the lengthwise direction of the print head 50 (the direction perpendicular to the paper conveyance direction) is reduced (high nozzle density is achieved).

The pressure chamber 52 provided corresponding to each of the nozzles 51 is approximately square-shaped in plan view, and a nozzle 51 and a supply port 54 are provided respectively at corners on a diagonal of the pressure chamber 52.

Figure 3:
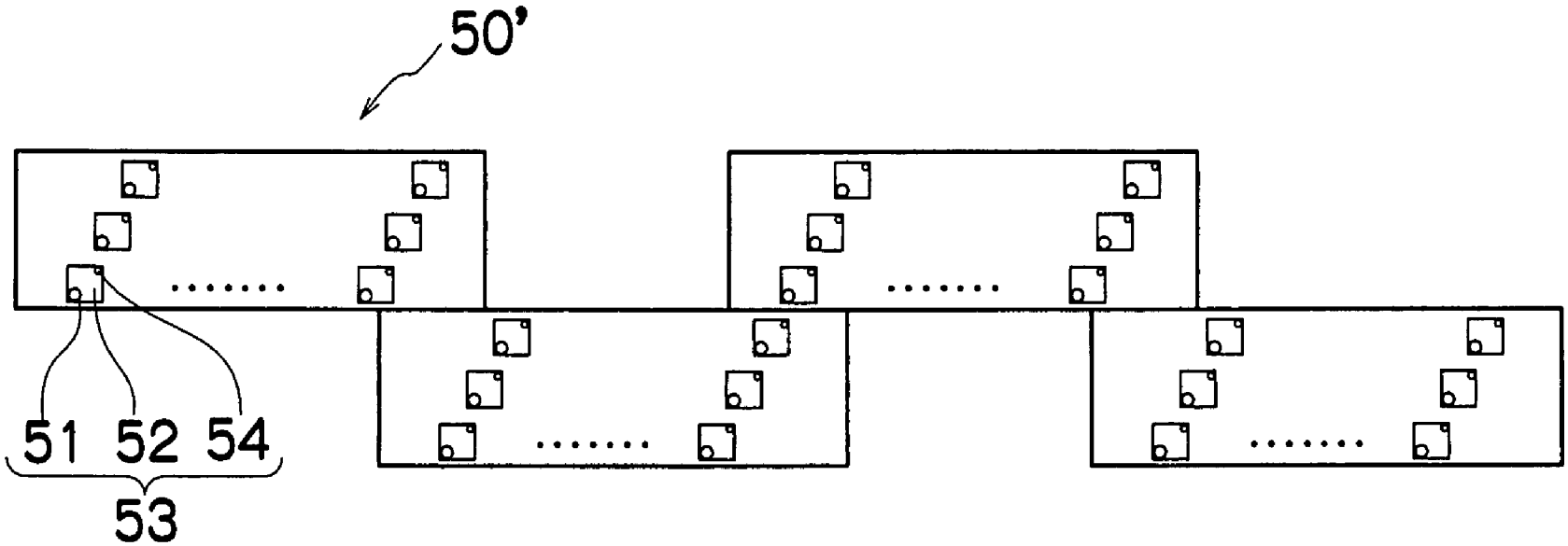
FIG. 3 is a plan perspective diagram showing a further embodiment of the structure of a print head.

Furthermore, instead of the composition in FIGS. 2A and 2B, as shown in FIG. 3, a full line head having nozzle rows of a length corresponding to the entire width of the recording paper 16 can be formed by arranging and combining, in a staggered matrix, short head units 50' each having a plurality of nozzles 51 arrayed in a two-dimensional fashion.

Figure 4:
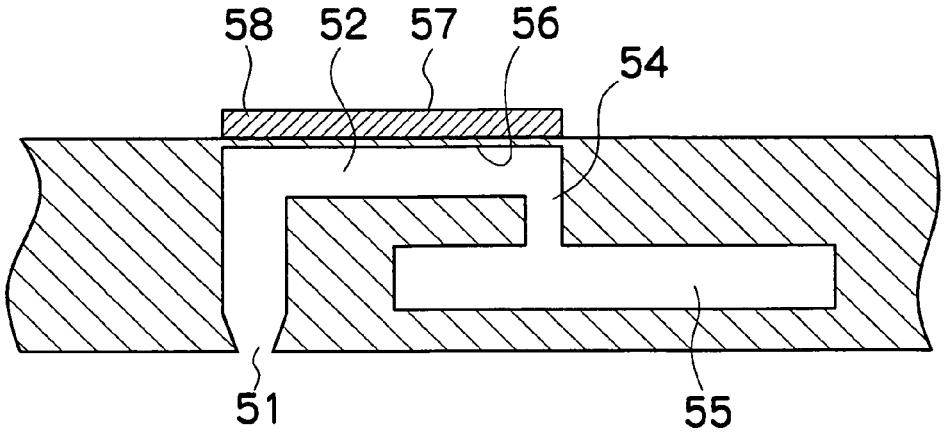
FIG. 4 is a cross-sectional diagram along line 4-4 in FIGS. 2A and 2B.

FIG. 4 is a cross-sectional diagram along line 4-4 in FIGS. 2A and 2B. As shown in FIG. 4, each pressure chamber 52 is connected to a nozzle 51 at one end, and to a common flow channel 55, through a supply port 54, at the other end. Furthermore, the common flow channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

A piezoelectric element (piezoelectric actuator) 58 provided with an individual electrode 57 is bonded to a diaphragm (common electrode) 56, which forms the upper faces of the pressure chambers 52. A piezoelectric body is suitable as the piezoelectric element 58. When a drive voltage is applied to the individual electrode 57, the piezoelectric element 58 deforms and an ink droplet is ejected from the nozzle 51. When an ink droplet is ejected, new ink is supplied to the pressure chamber 52 from the common flow passage 55, through the supply port 54.

Figure 5:
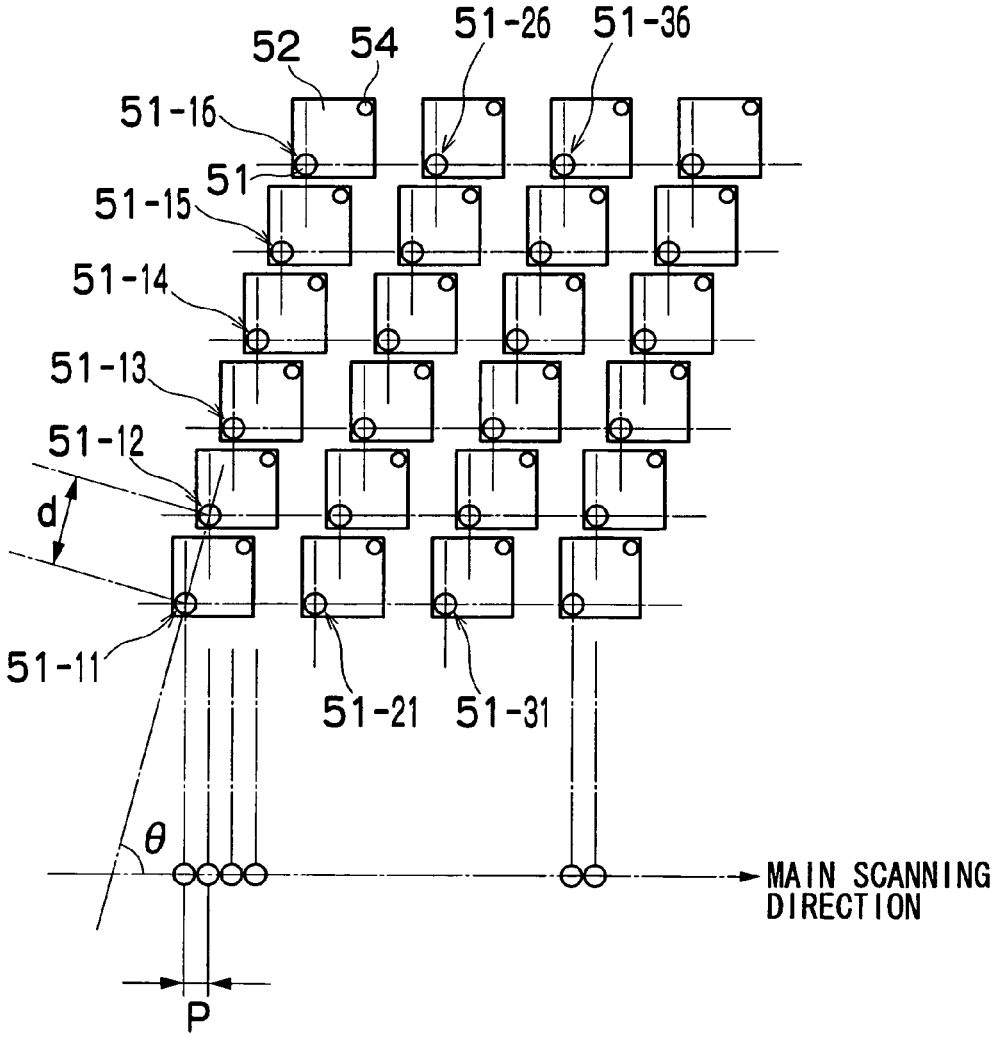
FIG. 5 is an enlarged view showing an embodiment of the nozzle arrangement in the print head shown in FIGS. 2A and 2B.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction.

More specifically, by adopting a structure in which the plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density.

In a full-line head comprising rows of nozzles that have a length corresponding to the entire width of the image recordable width, the "main scanning" is defined as printing one line or a single strip in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

According to the present invention, the arrangement of the nozzles is not limited to that of the embodiment shown. Moreover, in the present embodiment, a piezoelectric method is employed in which an ink droplet is ejected by means of the deformation of a piezoelectric element 58, but in implementing the present invention, there are no particular restrictions on the method used for ejecting ink, and instead of a piezoelectric method, it is also possible to apply various other types of methods, such as a thermal jet method, wherein the ink is heated and bubbles are caused to form therein, by means of a heat generating body, such as a heater, ink droplets being ejected by means of the pressure created by these bubbles.

Configuration of Ink Supply System

Figure 6:
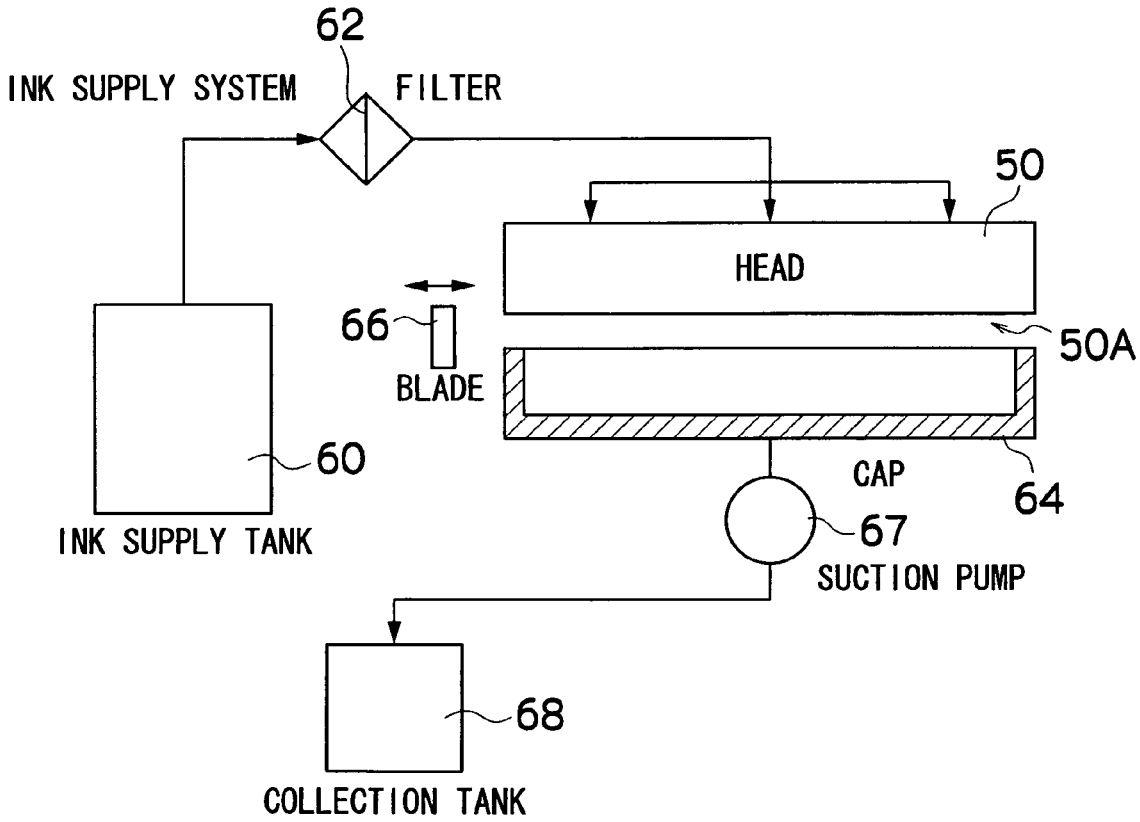
FIG. 6 is a schematic drawing showing the composition of an ink supply system in the inkjet recording apparatus.

FIG. 6 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the print head 50 as shown in FIG. 6. The filter mesh size in the filter 62 is preferably equivalent to or less than the diameter of the nozzle. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the nozzle surface 50A of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or standby, when the frequency of use of specific nozzles 51 is reduced and ink viscosity increases in the vicinity of the nozzles, a preliminary discharge is made to eject the degraded ink toward the cap 64.

Also, when bubbles have become intermixed in the ink inside the print head 50 (inside the pressure chamber), the cap 64 is placed on the print head 50, the ink inside the pressure chamber (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the print head 50, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 for the ejection driving is operated. Before reaching such a state (in a viscosity range that allows ejection by the operation of the piezoelectric element 58) the piezoelectric element 58 is operated to perform the preliminary discharge to eject the ink whose viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed into the ink inside the nozzles 51 and the pressure chambers 52, or when the viscosity of the ink inside the nozzle 51 has increased over a certain level, ink can no longer be ejected from the nozzles even if the piezoelectric elements 58 are operated. In a case of this kind, a cap 64 is placed on the nozzle surface 50A of the print head 50, and the ink containing air bubbles or the ink of increased viscosity inside the pressure chambers 52 is suctioned by a pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Next, the control system of the inkjet recording apparatus 10 is described.

Figure 7:
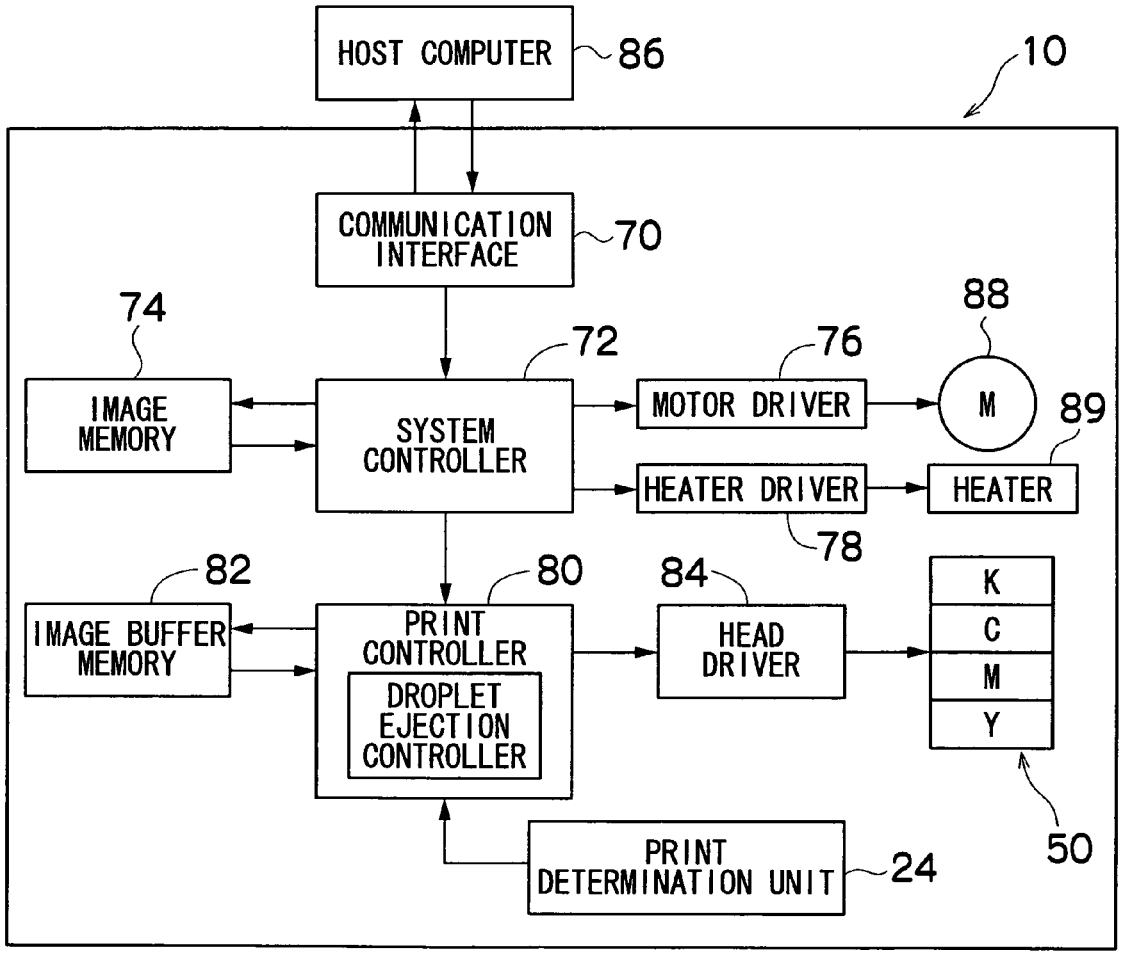
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or other units in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (dot data) to the head driver 84.

Prescribed signal processing is carried out in the print controller 80, and the ejection amount and the ejection timing of the ink droplets from the respective print heads 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric element 58 of the head 50 of the respective colors on the basis of print data supplied by the print controller 80. The head driver 84 can be provided with a feedback control system for maintaining constant drive conditions for the print heads.

The image data to be printed is externally inputted through the communications interface 70, and is stored in the image memory 74. At this stage, RGB image data is stored in the image memory 74, for example. The image data stored in the image memory 74 is sent to the print controller 80 through the system controller 72, and is converted into dot data for each ink color by a known dithering algorithm, random dithering algorithm or another technique in the print controller 80.

The print head 50 is driven on the basis of the dot data thus generated by the print controller 80, so that ink is ejected from the head 50. By controlling ink ejection from the print heads 50 in synchronization with the conveyance speed of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80. The read start timing of the line sensor is determined from the distance between the sensor and the nozzle and the conveyance speed of the recording paper 16.

According to requirements, the print controller 80 makes various corrections with respect to the head 50 on the basis of information obtained from the print determination unit 24. The print controller 80 judges whether or not the nozzles 51 have performed ejection, on the basis of the determination information obtained by means of the print determination unit 24, and if the print controller 80 detects a nozzle that has not performed ejection, then it implements control for performing a prescribed restoring operation. Furthermore, the droplet ejection control unit of the print controller 80 implements the droplet ejection control described below.

Droplet Ejection Control Method

Next, the droplet ejection control method according to an embodiment of the present invention is described.

Figure 8:
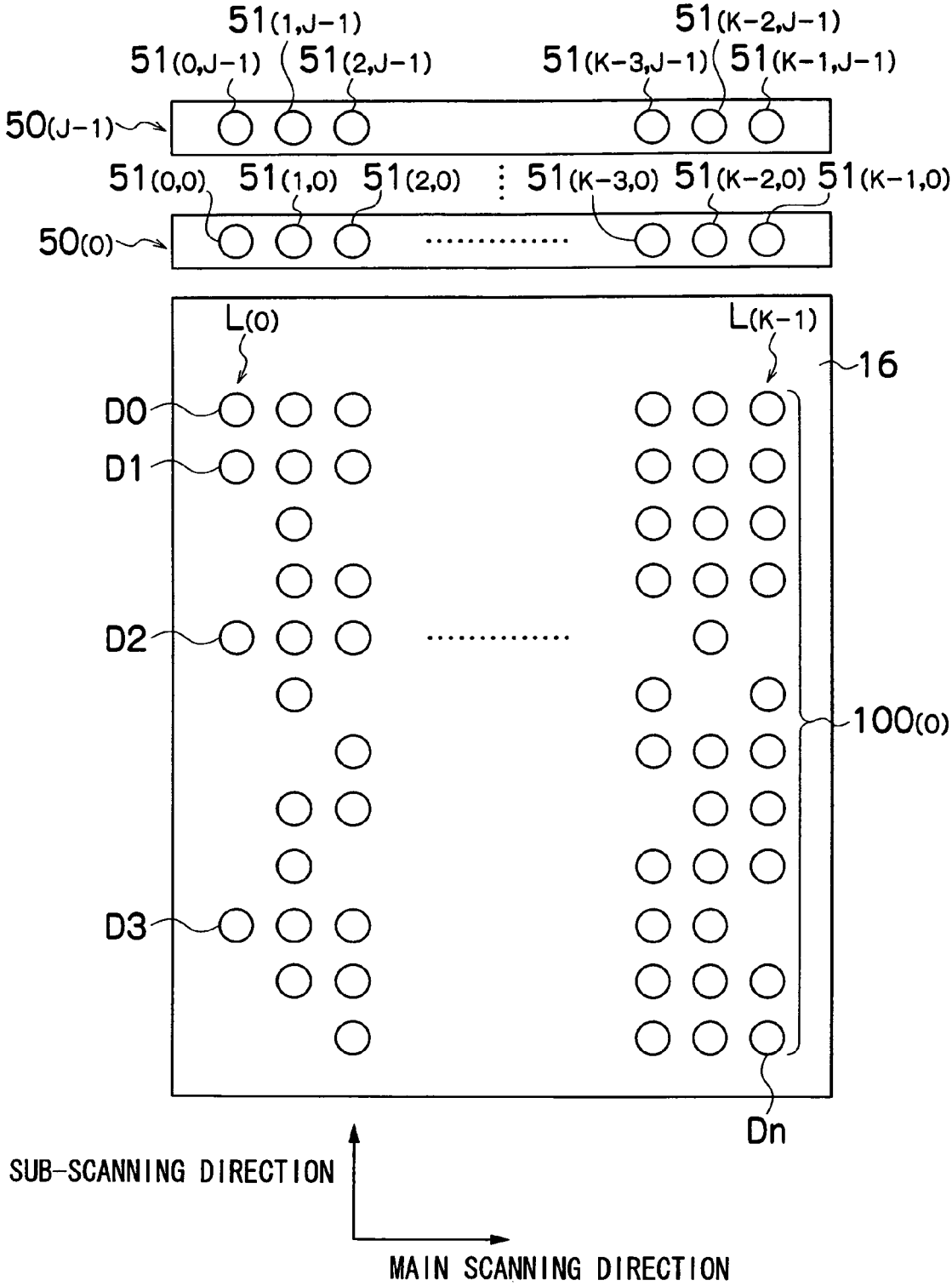
FIG. 8 is an illustrative diagram showing an example of dot data corresponding to a print head.

FIG. 8 is an illustrative diagram showing an example of dot data corresponding to a print head. Here, a case is described in which J print heads 50(0), . . . , 50(J−1) of different colors each comprise K nozzles 51 arranged in one row in the main scanning direction, which is the breadthways direction of the recording paper 16. For example, the print head 50(0) has K nozzles 51(0, 0), 51(1, 0), . . . , 51(K−2, 0), 51(K−1, 0). The number inside the brackets of the reference numeral 50 relating to the print head indicates the ink number. The first number inside the brackets of the reference numeral 51 relating to the nozzle indicates the nozzle number, and the last number indicates the ink number. Furthermore, in order to simplify the description, a case is described here in which each print head comprises a nozzle row arranged in one row in the main scanning direction, but the droplet ejection control method of the present invention may also be applied similarly to a case where a plurality of nozzles 51 are arranged in a staggered matrix fashion, as shown in FIGS. 2A and 2B.

The plurality of dots D0, D1, . . . , Dn displayed on the recording paper 16 are dot data 100(0) generated by the print controller 80 (see FIG. 7) on the basis of the image data. The dot data 100(0) corresponds to the print head 50(0), and although not shown in the drawings, dot data 100(1), . . . , 100(J−1) corresponding to the other print heads 50(1), . . . , 50(J−1) are also created. The number inside the brackets of the reference numeral 100 relating to the dot data indicates the ink number. Since the droplet ejection operation is similar in each of the print heads 50(0), . . . , 50(J−1), below, the droplet ejection operation of the print head 50(0) is described as a representative example.

In a normal droplet ejection operation of the print head 50(0), the recording paper 16 is conveyed in the sub-scanning direction (paper conveyance direction), and the nozzles 51(0, 0), . . . , 51(K−1, 0) of the print head 50(0) respectively eject droplets to form dots of the dot columns L(0) to L(K-1), which are aligned in the sub-scanning direction. For example, the nozzle 51(0, 0) ejects droplets to form the dots D0, D1, D2 and D3, in the dot column L(0) in the sub-scanning direction.

Figure 9:
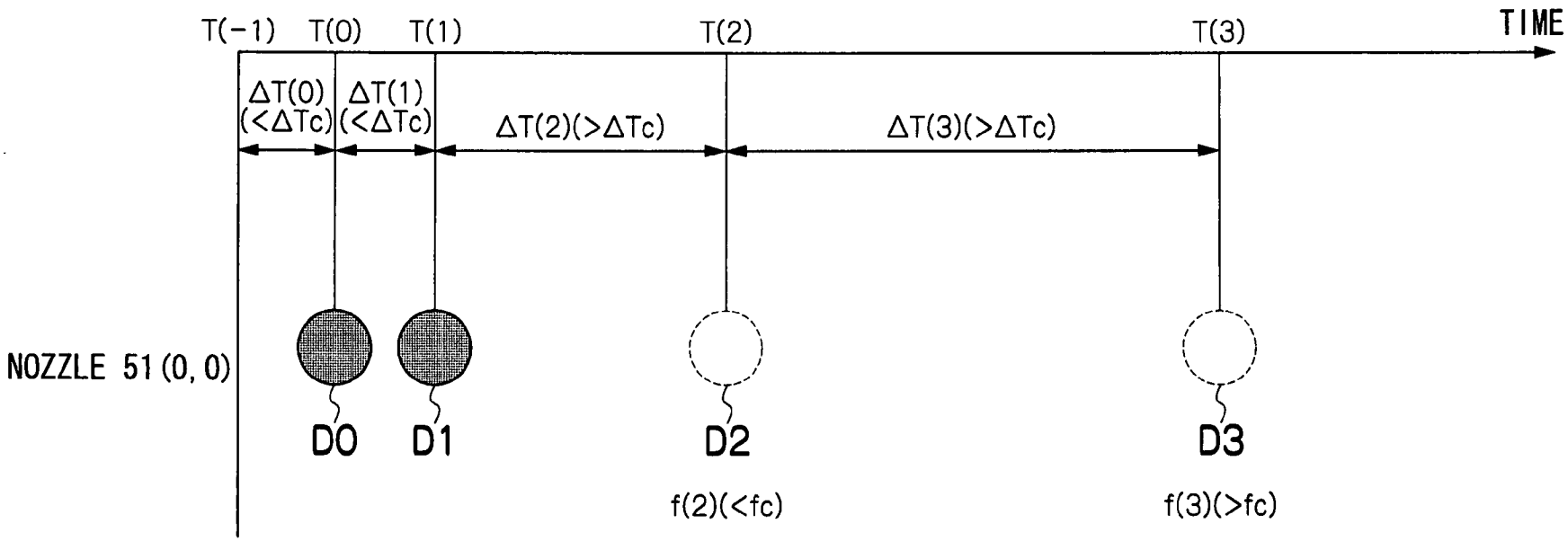
FIG. 9 is an illustrative diagram which shows the droplet ejection timings of the nozzle 51(0, 0) in FIG. 8.

FIG. 9 is an illustrative diagram showing the droplet ejection timing of the nozzle 51(0, 0) in FIG. 8. As shown in FIG. 9, taking the time of the start of the print operation of the print head 50(0) to be zero, the droplet ejection timings (droplet ejection times) at which the nozzle 51(0, 0) is to eject droplets to form the dots D0 to D3 are T(0), T(1), T(2) and T(3), respectively. The time at which the print operation starts is taken to be T(−1) (i.e., T(−1)=0). Furthermore, the droplet ejection intervals of the nozzle 51(0, 0) are, respectively, ΔT(0)(=T(0)−T(−1)),ΔT(1)(=T(1)−T(0)), ΔT(2)(=T(2)−T(1)), and ΔT(3)(=T(3)−T(2)). Here, the droplet ejection interval at which an ejection defect occurs in the nozzle (hereinafter, called the ejection defect droplet ejection interval) is taken to be ΔTc, and it is supposed that ΔT(0) and ΔT(1) are smaller than ΔTc, while ΔT(2) and ΔT(3) are greater than ΔTc.

When a normal droplet ejection operation is carried out in this case, then as shown in FIG. 9, a droplet is ejected to form the first dot D0 at the droplet ejection interval ΔT(0) which is shorter than the ejection defect droplet ejection interval ΔTc, from the start of the print operation, and therefore, the dot D0 is a normal dot (indicated by a solid circle in FIG. 9) formed by the correctly ejected droplet. Furthermore, a droplet is ejected to form the dot D1 at droplet ejection timing T(1), which is at the droplet ejection interval ΔT(1) that is shorter than the ejection defect droplet ejection interval ΔTc, after the ejection of the previous dot D0 at the droplet ejection timing T(0). Therefore, the dot D1 is formed as a normal dot formed by the correctly ejected droplet. On the other hand, a droplet is ejected to form the dot D2 at the droplet ejection timing T(2), which comes at the droplet ejection interval ΔT(2) that is longer than the ejection defect droplet ejection interval ΔTc (prescribed time period), after the ejection of the previous dot D1 at the droplet ejection timing T(1). Therefore, the dot D2 is formed as a defective dot that is formed by the droplet having not been ejected correctly (indicated by the dotted circle in FIG. 9), due to an ejection defect in the nozzle 51(0, 0). Moreover, since the nozzle 51(0, 0) has already had the ejection defect at the droplet ejection timing T(2) of the dot D2, then the dot D3 formed by a droplet ejected subsequently to the droplet ejection timing T(2) of the defective dot D2 will also be a defective dot, regardless of the length of the droplet ejection interval ΔT(3).

If the nozzle 51(0, 0) produces an ejection defect in this manner, then defective dots will occur continuously, unless a maintenance operation such as preliminary ejection or suctioning is performed, as described above. However, if a maintenance operation is performed frequently in cases of this kind, then there is a problem that the printing speed will decline. Therefore, in the present invention, the droplet ejection is controlled in such a manner that image deterioration due to ejection defects in the nozzles is prevented, without leading to a decline in printing speed.

FIG. 10 is a flowchart showing a droplet ejection control method according to a first embodiment of the present invention. In FIG. 10, the nozzle number in the print head is indicated by k (k=0, 1, . . . , K-1) and the ink number j (j=0, 1, . . . , J−1). Below, the flowchart shown in FIG. 10 is described with reference to the examples shown in FIG. 8 and FIG. 9.

Firstly, when a printing operation starts, dot data is created (step S310). In the present example, as shown in FIG. 8, the print controller 80 (see FIG. 7) creates dot data 100(0), . . . , 100(J−1) corresponding to the print heads 50(0), . . . , 50(J−1) of the respective colors, on the basis of the image data.

Next, the ink number j is set to 0 (step S320), and the nozzle number k is set to 0 (step S330). Here, the nozzle to be subjected to the droplet ejection control is selected. In the present example, the nozzle 51(0, 0) shown in FIG. 8 is selected first.

Thereupon, the droplet ejection timings T(0), T(1), . . . , T(N−1) of the nozzle under control 51(k, j) are determined. The droplet ejection timings indicate time periods with respect to the time point (T(−1)=0) at which the print operation of the print head 50(j) starts. Thereupon, the droplet ejection intervals ΔT(0) (=T(0)−T(−1)), ΔT(1) (=T(1)−T(0), . . . , ΔT(N−1) (=T(N−1)−T(N−2)) are determined, from the respective droplet ejection timings (step S340). Here, N is any natural number equal to or greater than 1. T(N−1) is the droplet ejection timing of the last dot when all of the image data for one print job (several sheets of printing paper), or all of the image data until the performance of a maintenance operation originated by a separate cause, has been developed and computed. In the present example shown in FIG. 9, the droplet ejection timings of the dots D0 to D3 formed by droplets ejected from the nozzle under control 51(0, 0) are T(0) to T(3), the droplet ejection intervals are ΔT(0) to ΔT(3), and the value of N is 4.

Thereupon, 0 is introduced for the variable i (step S350), and the length of the droplet ejection interval ΔT(i) and the ejection defect droplet ejection interval ΔTc are compared (step S360). Here, it is judged whether or not a defective dot occurs in the dot formed by the droplet ejected by the nozzle under control. If the droplet ejection interval ΔT(i) is longer than the ejection defect droplet ejection interval ΔTc, then the procedure advances to step S380, whereas if the droplet ejection interval ΔT(i) is equal to or shorter than the ejection defect droplet ejection interval ΔTc, then the procedure advances to step S370. In the present example, as shown in FIG. 9, when i=0, the droplet ejection interval ΔT(0) is equal to or shorter than the ejection defect droplet ejection interval ΔTc, and therefore, the value of the variable i is incremented by 1 (step S370), and since the resulting value of the variable i (i.e., 1), is smaller than the value of N (i.e., 4) then the procedure returns to step S360 (step S610). When i=1, similar processing to the case of i=0 is carried out. When i=2, the droplet ejection interval ΔT(2) is longer than the droplet ejection interval ΔTc in the example shown in FIG. 9, and therefore, the procedure advances to step S380.

Next, the values f(i), f(i+1), . . . , f(N−1) are calculated for an image effect function f, which represents the degree of the effect on the image (hereinafter, called "image effect level") which would occur if no droplets are ejected to form dots, at the droplet ejection timings T(i), T(i+1), . . . , T(N−1), respectively (step S380). The dots formed by droplets ejected at droplet ejection timings T(i), T(i+1), . . . , T(N−1) are defective dots, and here, the effect on the image is calculated for a case where droplets are not ejected to form these defective dots. In the present example, since step S380 is carried out when i=2, then the respective image effect levels f(2) and f(3) corresponding to cases where droplets are not ejected to form defective dots D2 and D3 at the droplet ejection timings T(2) and T(3), are calculated.

The image effect function f is described here. The original (most desirable) dot data created from the image data is taken to be α, and the dot data in which at least one defective dot has occurred (or in which at least one dot has been added or substituted) is taken to be β. The image effect function f represents the effect occurring when an image is formed on the basis of the dot data β, in a case where the image is supposed to be formed on the basis of the dot data α. The image effect function f is represented by the total number of pixels, x, in each of which there is a difference in terms of the presence or absence of a dot in the pixel, between the sets of dot data α and β. Furthermore, desirably, the evaluation region T based on the image effect function f is changed in accordance with the required level of image quality. For example, if high image quality is demanded, then it is desirable to set the evaluation region T to a narrow range. It is even more desirable to apply a weighting on the value of x, in accordance with the color of the dots and the volume of the liquid droplets. Therefore, desirably, the image effect function f is expressed as:

$$f = \sum_{j,V} (C_{j,V} x_{j,V}),$$

where j is the color, V is the dot volume, $C_{j,V}$ is the weighting parameter corresponding to the dot (j, V), and $x_{j,V}$ is the total number of dots (j, V) that are changed between the dot data α and the dot data β, in the evaluation region T.

The tolerance limit of the image effect function f is fc. The tolerance limit fc corresponds to the threshold value of x which is tolerated with the evaluation region T, and this threshold value varies depending on the density and color hue of the original dot data α. Therefore, desirably, the tolerance limit fc is changed in accordance with the density and color hue. In the present example shown in FIG. 9, the image effect level f(2) is smaller than the tolerance limit fc, and the image effect level f(3) is greater than the tolerance limit fc.

Next, the value of the variable i is introduced for the variable i' (step S390), and the size of the image effect level f(i') is compared with the tolerance limit fc (step S400). If the image effect level f(i') is equal to or less than the tolerance limit fc, then the value of the variable i' is incremented by one (step S410), and it is judged whether or not the value of this variable i' is N (step S420). If the value of the variable i' is not equal to N, then the procedure returns to step S400, whereas if the value of the variable i' is equal to N, then the procedure moves to step S620.

In the present example, at the time that step S400 is processed for the first time, i'=2. In this case, the image effect level f(2) is smaller than fc, and the procedure moves to step S410, where the value of the variable i' is incremented by 1 and thus becomes 3. Since the variable i' (=3) is lower than N (=4), then the procedure returns again to step S400, and the sizes of f(3) and fc are compared with each other. If f(3) is greater than fc, then the procedure moves to the next step, S430.

Up to this point, the defective dots D2 and D3 are extracted on the basis of comparisons between the droplet ejection intervals ΔT(1) to ΔT(3) of the nozzle under control 51(0, 0), and the ejection defect droplet ejection interval ΔTc, and furthermore, the defective dot D3 that affects the image is extracted on the basis of comparisons between the image effect levels f(2) and f(3) obtained if droplets are not ejected to form the defective dots D2 and D3, and the tolerance limit fc. In the subsequent processing step, droplet ejection correction processing is carried out in the droplet ejection correction period until the droplet ejection timing T(3) of the defective dot D3, from the droplet ejection timing T(1) of the previously formed correct dot D1, in such a manner that the nozzle under control 51(0, 0) ejects a droplet correctly to form the dot D3 that would affect the image if the correction were not performed.

Firstly, the result of [(T(i')−T(i−1))/ΔTc] is substituted for the variable M (step S430), where [x] represents the maximum integer that does not exceed the value of x. The value of (T(i')−T(i−1)) represents the duration of the droplet ejection correction period, from the ejection of the droplet forming the correct dot until the ejection of the droplet forming the dot that would affect the image if the correction were not performed. The maximum integer M that does not exceed the result of this value divided by the ejection defect droplet ejection interval ΔTc represents the number of sub-periods which must be set in the droplet ejection correction period. The sub-periods S(0), S(1), . . . , S(M−1) are set within the droplet ejection correction period U (step S440). If the start timing of the sub-period S(m) (where 0≦m≦M−1) is taken to be SS(m) and the end timing thereof is taken to be SG(m), then the following relationship is satisfied: SG(m)−SS(m−1) ≦ΔTc. Here, SS(−1)=T(i−1) and SG(M)=T(i').

Figure 11:
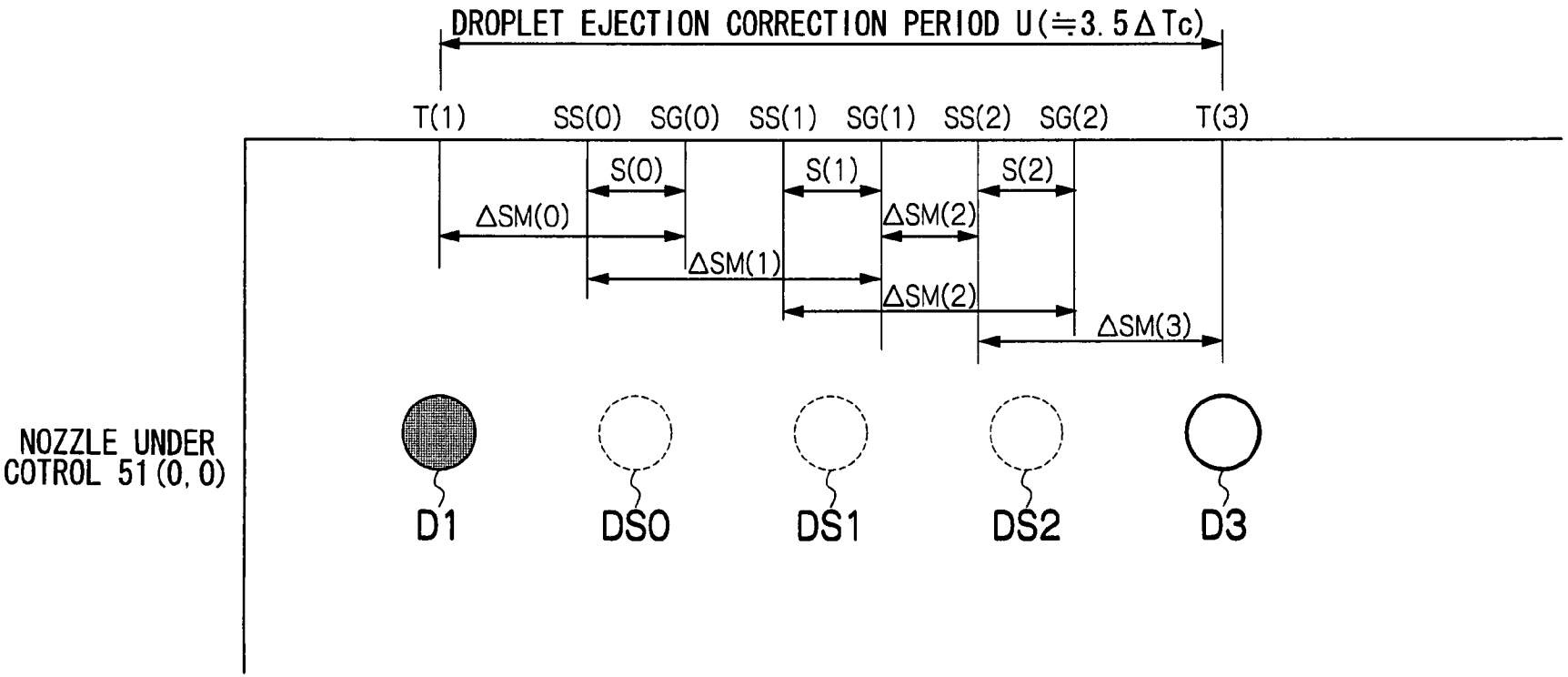
FIG. 11 is an illustrative diagram of a case in which subperiods are set in the example shown in FIG. 9.

FIG. 11 is an illustrative diagram of a case where the sub-periods are set for the example in FIG. 9. The dots D0 and D2 in FIG. 9 are omitted from the drawing. At the time that the step S430 is carried out, i'=3 and i−1=1, and the droplet ejection correction period U is the period between the droplet ejection timing T(1) of the correct dot D1 and the droplet ejection timing T(3) of the dot D3, which would affect the image if the correction were not performed. In order that the nozzle under control 51(0, 0) can eject a droplet to form the dot D3 correctly, it is necessary for the nozzle under control 51(0, 0) to eject droplets to form the corrected dots DS0, DS1 and DS2, at prescribed intervals, within the droplet ejection correction period U. Here, the intervals during which the nozzle under control 51(0, 0) must eject droplets to form the corrected dots DS0, DS1 and DS2 within the droplet ejection correction period U, are defined as the sub-periods. As shown in FIG. 11, if the droplet ejection correction period U is taken to be approximately 3.5 times the ejection defect droplet ejection interval ΔTc, then the number of sub-periods that must be set in the droplet ejection correction period U is 3. The number of sub-periods M is determined as [(T(3)−T(1))/ΔTc]. If the start timings and the end timings of the respective sub-periods S0 to S2 are taken respectively to be SS(0), SG(0), SS(1), SG(1), SS(2) and SG(2), then the respective sub-periods S(0), S(1) and S(2) are set in such a manner that the respective intervals between the start and end timings T(1) and T(3) of the sub-periods S(0) to S(2) and the droplet ejection correction period U (namely, the intervals ΔSM(0) =SG(0)−T(1), ΔSM(1)=SG(1)−SS(0), ΔSM(2)=SG(2)−SS(1), and ΔSM(3)=T(3)−SS(2)), are each shorter than the ejection defect droplet ejection interval ΔTc. If droplet ejection correction is carried out in such a manner that the nozzle under control 51(0, 0) ejects droplets to form the corrected dots DS0, DS1 and DS2 in the sub-periods S(0), S(1) and S(2) set in this fashion, then it is possible to correctly eject a droplet to form the dot D3, which would affect the image if the correction were not performed, without the nozzle under control 51(0, 0) causing an ejection defect.

Next, 0 is substituted for the variable m (step S450), and it is judged whether or not there exists a dot formed by a droplet ejected by the adjacent nozzle 51(k+1, j) in the sub-period S(m) (step S460). In the present example, the nozzle 51(1, 0) is considered as an adjacent nozzle to the nozzle under control 51(0, 0). If there exists a dot formed by a droplet ejected by the adjacent nozzle 51(k+1, j) within the sub-period S(m), then the procedure advances to step S470, whereas if no such dot exists, then the procedure moves to step S500. If k=K−1, then this processing is not carried out and the procedure then moves to step S500.

Next, the image effect level f is calculated for a case where a dot formed by a droplet ejected by the nozzle under control 51(k, j) is substituted for the dot formed by the droplet ejected by the adjacent nozzle 51(k+1, j) (step S470), and this image effect level f is compared with the tolerance limit fc (step S480). If the image effect level f is equal to or lower than the tolerance limit fc, then the dot formed by the droplet ejected by the nozzle under control 51(k, j) is substituted for the dot formed by the droplet ejected by the adjacent nozzle 51(k+1, j) (step S490).

If it is judged at step S460 that there is no dot formed by a droplet ejected by the adjacent nozzle 51(k+1, j) within the sub-period S(m), or if it is judged at step S480 that the image effect level f occurring when the dot formed by the droplet ejected by the nozzle under control 51(k, j) is substituted for the dot formed by the droplet ejected by the adjacent nozzle 51(k+1, j) is greater than the tolerance limit fc, then a judgment is made regarding whether or not there exists, within the sub-period S(m), a dot formed by a droplet ejected by one of nozzles 51(k, j+1), . . . , 51(k, J−1) that have the same nozzle number k as the nozzle under control 51(k, j) and that eject droplets of different colors onto the same pixel as the nozzle under control 51(k, j) (hereinafter, referred to as "different color nozzles") (step S500). If there exists a dot formed by a droplet ejected by one of the different color nozzles 51(k, j+1), . . . , 51(k, J−1) within the sub-period S(m), then the procedure moves to step S510, whereas if no such dot exists, then the procedure moves to step S540. If j=J−1, then this processing is not carried out and the procedure then moves to step S540.

Next, the image effect level f is calculated for a case where the dot formed by the droplet ejected by the nozzle under control 51(k, j) is substituted for the dot formed by the droplet ejected by the one of the different color nozzles 51(k, j+1), . . . , 51(k, J−1) (step S510), and this image effect level f is compared with the tolerance limit fc (step S520). If the image effect level f is equal to or lower than the tolerance limit fc, then the dot formed by the droplet ejected by the nozzle under control 51(k, j) is substituted for the dot formed by the droplet ejected by the one of the different color nozzles 51(k, j+1), . . . , 51(k, J−1) (step S530).

If it is judged at step S500 that no dot formed by a droplet ejected by any of the different color nozzles 51(k, j+1), . . . , 51(k, J−1) is present in the sub-period S(m), or if it is judged at step S590 that the image effect level f in the case where the dot formed by the droplet ejected by the nozzle under control 51(k, j) is substituted for the dot formed by the droplet ejected by the one of the different color nozzles 51(k, j+1), . . . , 51(k, J−1) is greater than the tolerance limit fc, then the image effect level f is calculated for a case where a dot formed by a droplet ejected by the nozzle under control 51(k, j) is added within the sub-period S(m) (step S540), and this image effect level f is compared with the tolerance limit fc (step S550). If the image effect level f is equal to or lower than the tolerance limit fc, then the dot formed by the droplet ejected by the nozzle under control 51(k, j) is added (step S560).

In the present example, as shown in FIG. 11, the droplet ejection correction processing is carried out in such a manner that the nozzle under control 51(0, 0) ejects the droplets to form the corrected dots DS0, DS1 and DS2, either by substituting for dots formed by droplets ejected from adjacent nozzles or from different color nozzles, or by adding dots formed by the droplets ejected by the nozzle under control, in the respective sub-periods S(0), S(1) and S(2) of the droplet ejection correction period U. Therefore, the nozzle under control 51(0, 0) is able to eject a droplet correctly to form the dot D3, which would affect the image if the correction were not performed, at the final droplet ejection timing T(3) of the droplet ejection correction period U.

If it is judged at step S550 that the image effect level f in the case where the dot formed by the droplet ejected by the nozzle under control 51(k, j) is added in the sub-period S(m) is greater than the tolerance limit fc, then a purge sequence is inserted within the sub-period S(m) (step S570). In the purge sequence, the nozzle under control 51(k, j) performs a preliminary ejection.

When the processing in any one of steps S490, S530 and S560 is carried out, the value of the variable m is incremented by 1 (step S580), and the value of the variable m and the number of sub-periods M are compared (step S590). Here, it is judged whether or not the processing from step S460 to step S580 has been completed for each of the sub-periods S(0) to S(M−1). If m is not equal to M, then the procedure returns to step S460, whereas if m is equal to M, then the procedure moves to step S590.

If it is judged that m is equal to M at step S590, then the variable i is rewritten with the value of the variable i' plus 1 (step S600). In the present example, when step S600 is implemented, i'=3, and therefore, i=4.

Next, the value of the variable i is compared with N (step S610). If i is not equal to N, then the procedure returns to step S360, and if i is equal to N, then it moves to step S620. In the present example, i=4 and N=4, and therefore, the procedure moves to step S620.

If it is judged at step S610 that i is equal to N, or if it is judged at step S420 that i' is equal to N, then the value of the nozzle number k is incremented by 1 (step S620). The nozzle number k is then compared with the number of nozzles K (step S630). If k is not equal to K, then the procedure returns to step S340, whereas if k is equal to K, then the procedure moves to step S640.

If it is judged at step S630 that k is equal to K, then the value of the ink number j is incremented by 1 (step S640). It is then judged whether or not the ink number j is equal to the number of inks J (step S650). If j is not equal to J, then the procedure returns to step S330, whereas if j is equal to J, then the print operation terminates.

In the first embodiment, the droplet ejection intervals are calculated for the nozzle under control, on the basis of the dot data derived from the image data. Thereupon, if a droplet ejection interval of the nozzle under control is greater than the ejection defect droplet ejection interval (prescribed time period), and if the image will be affected should the dots that are to be ejected at and after the end timing of that droplet ejection interval become defective dots, then droplet ejection correction is carried out for the nozzle under control, in such a manner that the nozzle under control is able to eject droplets to form these dots. In other words, since droplet ejection correction is not implemented in respect of dots which will not affect the image, it is possible to prevent image deterioration due to ejection defects in the nozzles, without leading to a decline in the printing speed.

Furthermore, in the first embodiment, one of the following droplet ejection correction processes: (1) substitution of a dot formed by a droplet ejected by the nozzle under control for a dot to be formed by a droplet ejected by an adjacent nozzle, (2) substitution of a dot formed by a droplet ejected by the nozzle under control for a dot to be formed by a droplet ejected by a nozzle of a different color, and (3) addition of a dot formed by a droplet ejected by the nozzle under control, is carried out in each sub-period of the droplet ejection correction period. In this, the droplet ejection correction processing is carried out in such a manner that it does not affect the image, thereby preventing deterioration of the image due to the droplet ejection correction processing. Furthermore, the sub-periods in which the nozzle under control ejects droplets to form corrected dots are set in such a manner that ejection defects do not occur. Therefore, it is possible reliably to prevent the occurrence of ejection defects in the nozzle under control.

In the first embodiment, the sequence of performing the droplet ejection correction processes is shown in FIG. 10 as being: (1) substitution of a dot formed by a droplet ejected by the nozzle under control for a dot to be formed by a droplet ejected by an adjacent nozzle, (2) substitution of a dot formed by a droplet ejected by the nozzle under control for a dot to be formed by a droplet ejected by a nozzle of a different color, and (3) addition of a dot formed by a droplet ejected by the nozzle under control. However, when implementing the present invention, the sequence is not limited to this particular sequence.

Figure 12:
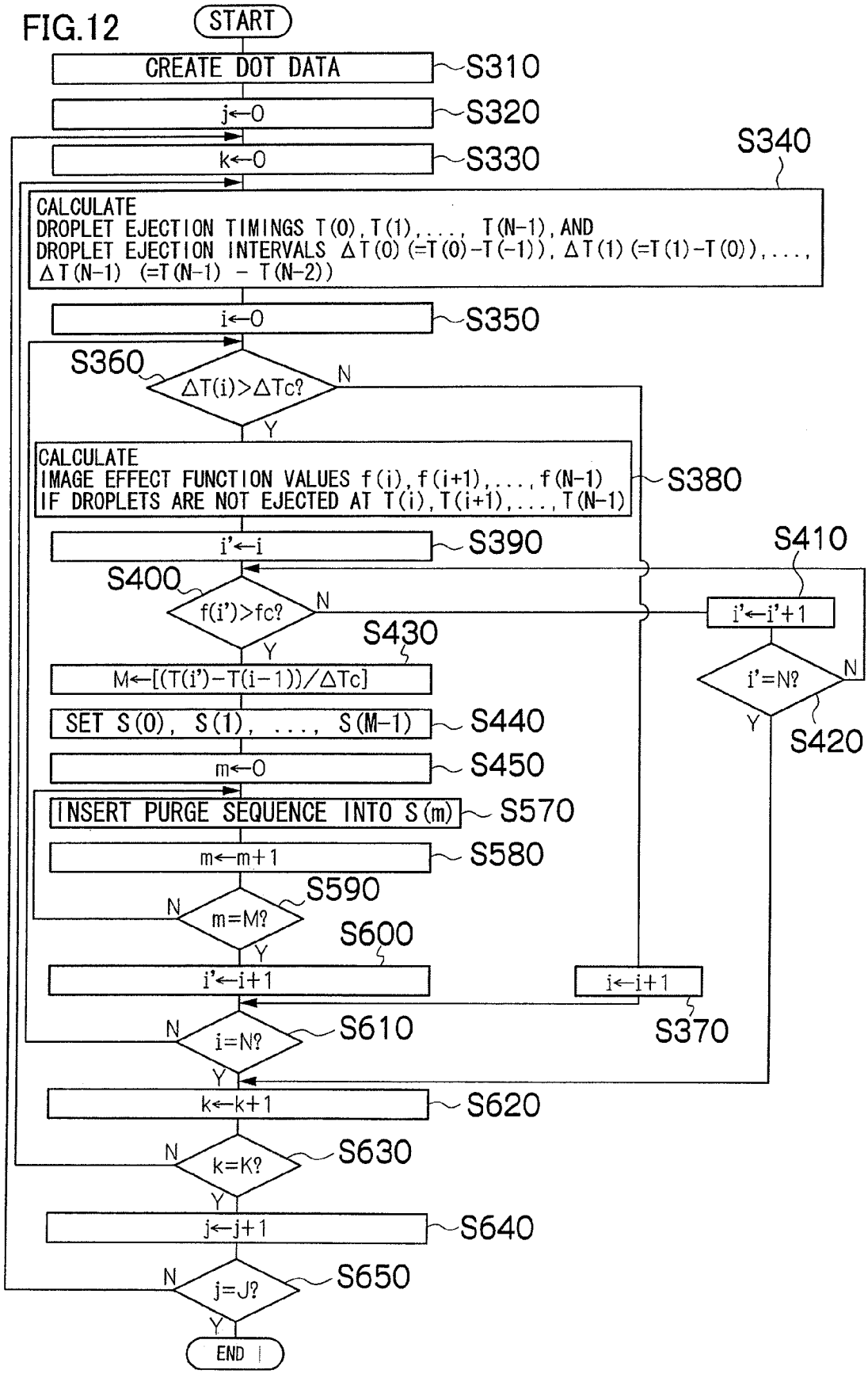
FIG. 12 is a flowchart showing a droplet ejection control method according to a second embodiment of the present invention.

FIG. 12 is a flowchart showing a droplet ejection control method according to a second embodiment of the present invention. In FIG. 12, processing steps which are common to FIG. 10 are denoted with the same step numbers.

In the second embodiment, if it is judged at step S400 that the image effect level f(i') is greater than the tolerance limit fc, then a purge sequence is inserted into all of the sub-periods S(0), . . . , S(M−1) of the droplet ejection correction period U (steps S450, S570, S580 and S590), rather than implementing substitution for a dot formed by a droplet ejected by an adjacent nozzle or by a different color nozzle, or addition of a dot formed by a droplet ejected by the nozzle under control, as in the first embodiment. On the other hand, if it is judged that the image effect level f(i') is equal to or lower than the tolerance limit fc, then a purging sequence is not inserted in this way. In other words, a purge sequence is inserted only when there is a dot that would affect the image if the purge sequence were not performed, and hence there are no wasteful actions in the print operation and reduction in the printing speed can be prevented. The remainder of the processing is the same as that of the first embodiment, and hence further description thereof is omitted here.

In the first and second embodiments, the line system using the full line head, which covers the whole width of the paper, is used as the print head 50, but in implementing the present invention, the head system is not limited to this, and it is also possible to adopt a shuttle system in which a short head is moved back and forth reciprocally in a direction (main scanning direction) which is perpendicular to the paper conveyance direction (sub-scanning direction)

Figure 13:
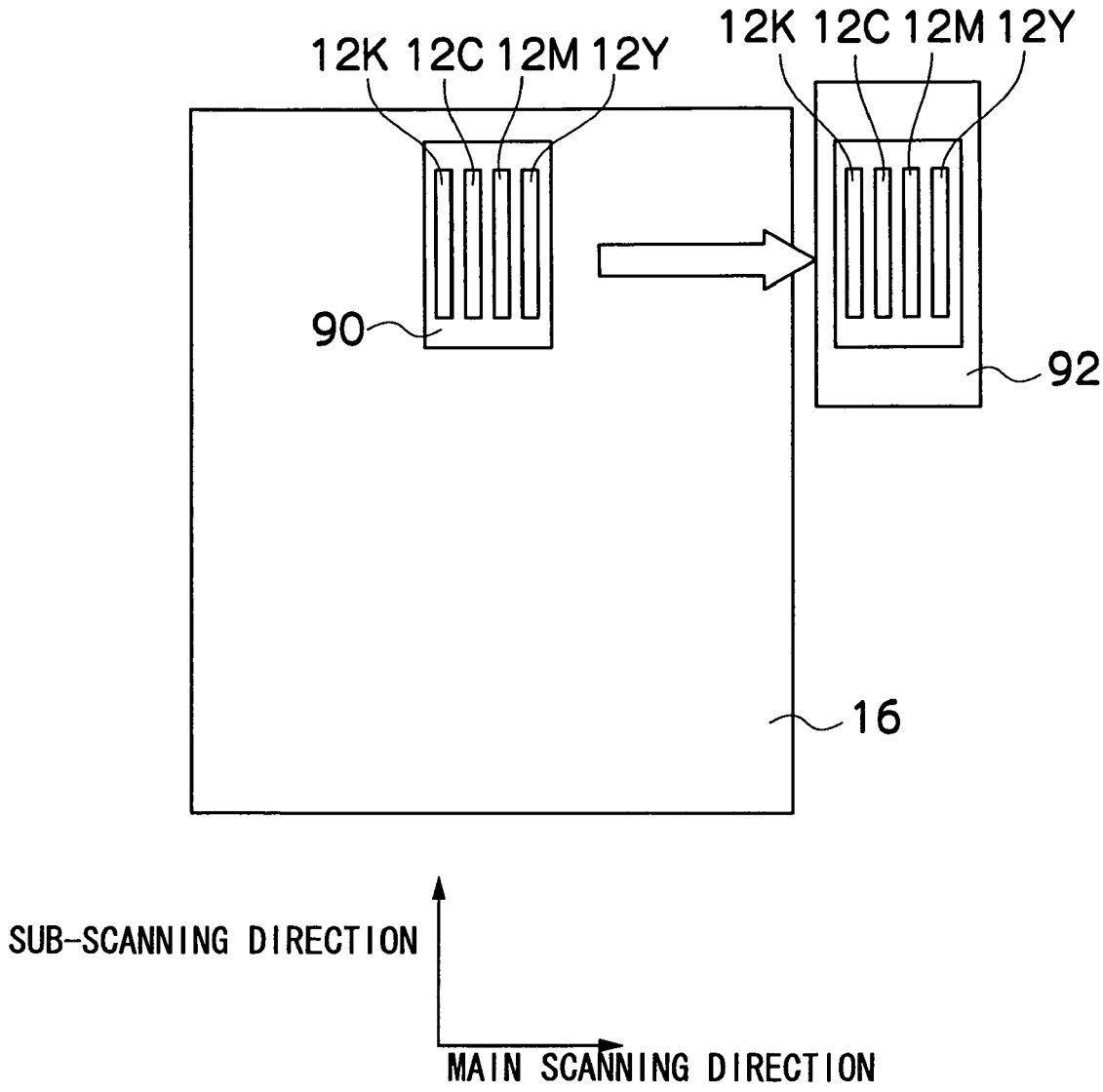
FIG. 13 shows an illustrative diagram of a case where a shuttle-type print head is used.
Figure 14:
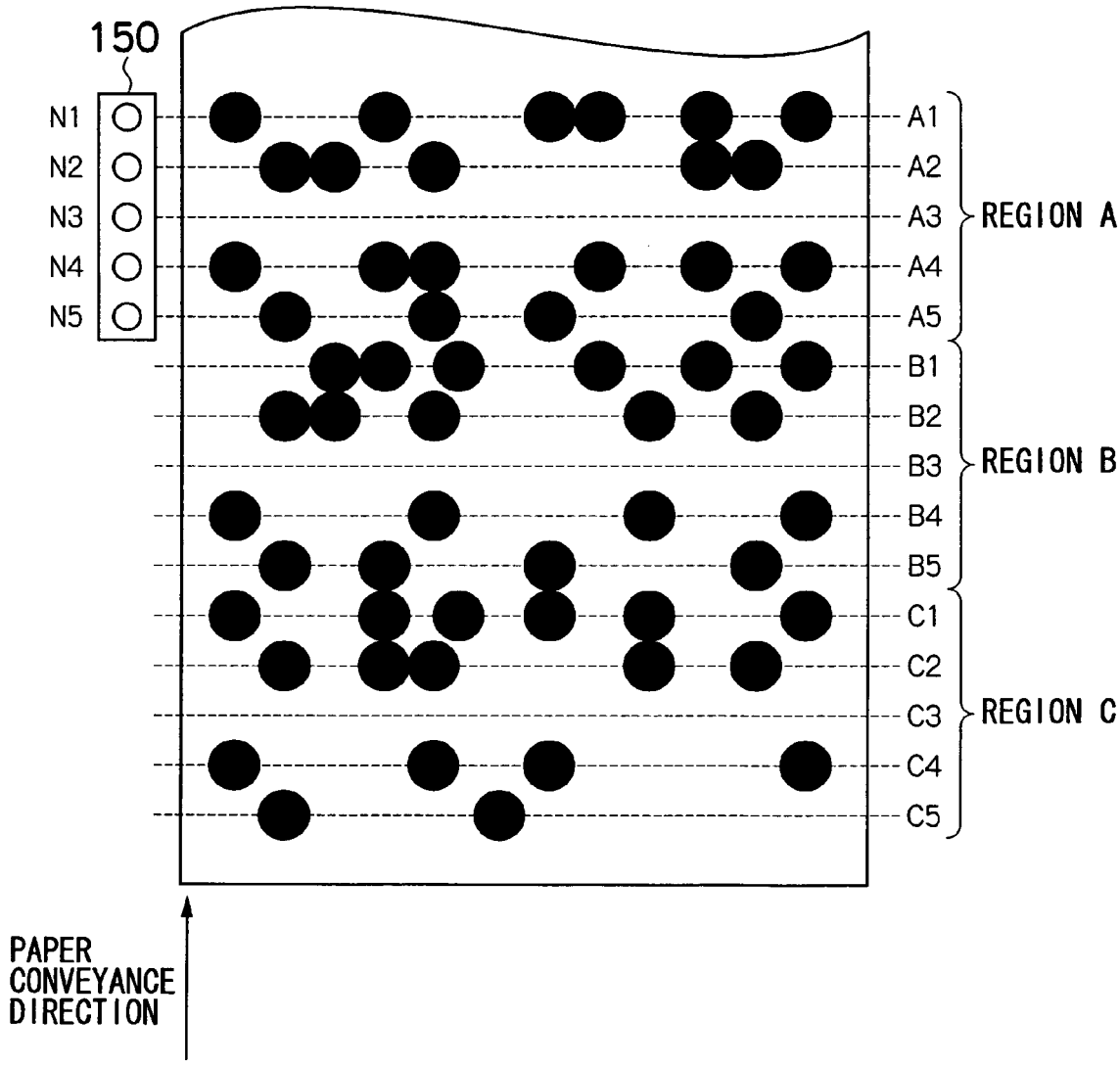
FIG.14 RELATED ART
FIG. 14 is an illustrative diagram of a droplet ejection control method in the related art.

FIG. 13 shows an illustrative diagram of a case where a scanning-type print head is used. As shown in FIG. 13, the print heads 12K, 12C, 12M and 12Y corresponding to respective colors are mounted in a carriage 90, each head having a nozzle column (not shown) arranged in the sub-scanning direction. An image is recorded onto recording paper 16 by scanning the recording paper 16 with the carriage 90 bearing the print heads 12K, 12C, 12M and 12Y, in the main scanning direction, while conveying the recording paper 16 in the sub-scanning direction. When a purge sequence is inserted, the carriage 90 bearing the print heads 12K, 12C, 12M and 12Y is moved to a purging zone 92 provided in a region in the main scanning direction where the recording paper 16 is not present, and preliminary ejection is carried out in this zone.

In the case of the scanning-type print head of this kind, the droplet ejection control is similar to the case of the line head as described above, the droplet ejection intervals of the nozzle under control being calculated on the basis of the dot data, and droplet ejection control being implemented on the basis of the flowcharts shown in FIG. 10 or FIG. 12.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection apparatus which forms an image on a recording medium in accordance with image data, comprising:

a plurality of ejection ports which eject droplets, the ejected droplets being deposited on the recording medium to form the image;

an ejection data generation device which generates ejection data for the plurality of ejection ports in accordance with the image data:

an ejection interval calculation device which calculates an ejection interval of a first ejection port of the ejection ports;

an ejection interval judgment device which judges whether or not the calculated ejection interval of the first ejection port exceeds an ejection defect period, the first ejection port suffering an ejection defect once the ejection interval of the first ejection port exceeds the ejection defect period;

a first image effect level judgment device which judges whether or not a first image effect level exceeds a first tolerance level, when the calculated ejection interval of the first ejection port is judged to exceed the ejection defect period, the first image effect level indicating an effect of the ejection defect of the first ejection port on the image; and an ejection control device which controls the first ejection port not to suffer from the ejection defect, when the first image effect level is judged to exceed the first to tolerance level.

2. The liquid droplet ejection apparatus as defined in claim 1, wherein the ejection control device controls the first ejection port to perform a purge operation so that the ejection interval of the first ejection port does not exceed the ejection defect period.

3. The liquid droplet ejection apparatus as defined in claim 1, wherein the ejection control device includes an ejection correction device which controls the first ejection port to perform an additional ejection so that the ejection interval of the first ejection port does not exceed the ejection defect period.

4. The liquid droplet ejection apparatus as defined in claim 3, wherein the ejection correction device substitutes the first ejection port for a second ejection port of the ejection ports so that the additional ejection is performed by the first ejection port, the second ejection port being one of the ejection ports other than the first ejection port.

5. The liquid droplet ejection apparatus as defined in claim 3, further comprising:

a second image effect level judgment device which judges whether or not a second image effect level exceeds a second tolerance level, when the first ejection port performs the additional ejection, the second image effect level indicating an effect of the additional ejection of the first ejection port on the image; and wherein when the second image effect level is not judged to exceed the second tolerance level, the ejection correction device controls the first ejection port to perform the additional ejection, and when the second image effect level is judged to exceed the second tolerance level, the ejection correction device controls the first ejection port not to perform the additional ejection.

6. The liquid droplet ejection apparatus as defined in claim 5, wherein the ejection control device controls the first ejection port to perform a purge operation when the second image effect level is judged to exceed the second tolerance level.

* * * * *